US005125688A

United States Patent [19]

Bianco

[11] Patent Number: 5,125,688

[45] Date of Patent: Jun. 30, 1992

[54] CALENDRICAL DEVICE

[75] Inventor: Ronald M. Bianco, Irvine, Calif.

[73] Assignee: Day Runner, Inc., Fullerton, Calif.

[21] Appl. No.: 561,913

[22] Filed: Aug. 2, 1990

[51] Int. Cl.[5] ..... B42D 5/04

[52] U.S. Cl. ..... 283/2; 283/4; 40/107

[58] Field of Search ..... 283/2, 3, 4; 40/107, 40/111, 113, 115

[56] References Cited

U.S. PATENT DOCUMENTS

| | | | |
|---|---|---|---|
| 224,335 | 2/1880 | Horton | 283/4 |
| 955,114 | 4/1910 | Brooks | 283/2 |
| 4,285,148 | 8/1981 | Kolar | 283/2 X |
| 4,863,193 | 9/1989 | Keshani | 283/2 |

FOREIGN PATENT DOCUMENTS

| | | | |
|---|---|---|---|
| 772324 | 4/1957 | United Kingdom | 283/36 |

*Primary Examiner*—Timothy V. Eley
*Assistant Examiner*—Willmon Fridie, Jr.
*Attorney, Agent, or Firm*—Pretty, Schroeder, Brueggemann & Clark

[57] ABSTRACT

A calendrical device is provided which selectively furnishes day and corresponding date information for successive years. The calendrical device includes a plurality of successive pages which are interconnected together and which are associated with a day identification mechanism that identifies the day corresponding to a given date. Each page contains an event indicating legend which has a separate date indicator corresponding to a separate date and separate day indicia that are characterized by a plurality of day indicators. Each of the day indicators corresponds to an individual day of a week and is arranged in a predetermined incremental day order relative to its counterpart day indicator occupying substantially the same location on a preceding page. The day identification mechanism includes a day identifying member that has a day marker. The day marker is selectively alignable with any one of the day indicators when the day identifying member is placed on any one of the day indicia contained on a given page. Thus, when the day marker aligns with a given day indicator, the calendrical device provides the appropriate day corresponds to a given date.

19 Claims, 3 Drawing Sheets

10
12
14
16
34
38
YAGOT
2 MARCH
28
MON
TUE
WED
THU
FRI
SUN
SAT
30
26
32
34
40
42
44
THU
1988
46
36
MARCH 3
21
18
24
20
18
22

34
38
TODAY
40

44
42
46
1988
36
2
3
4

FIG. 4
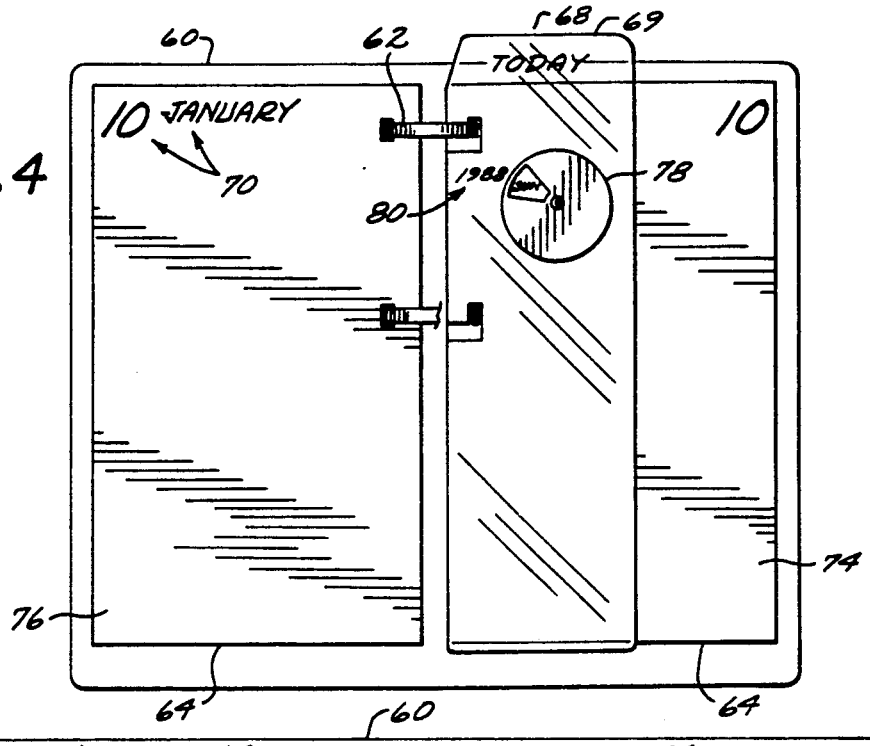
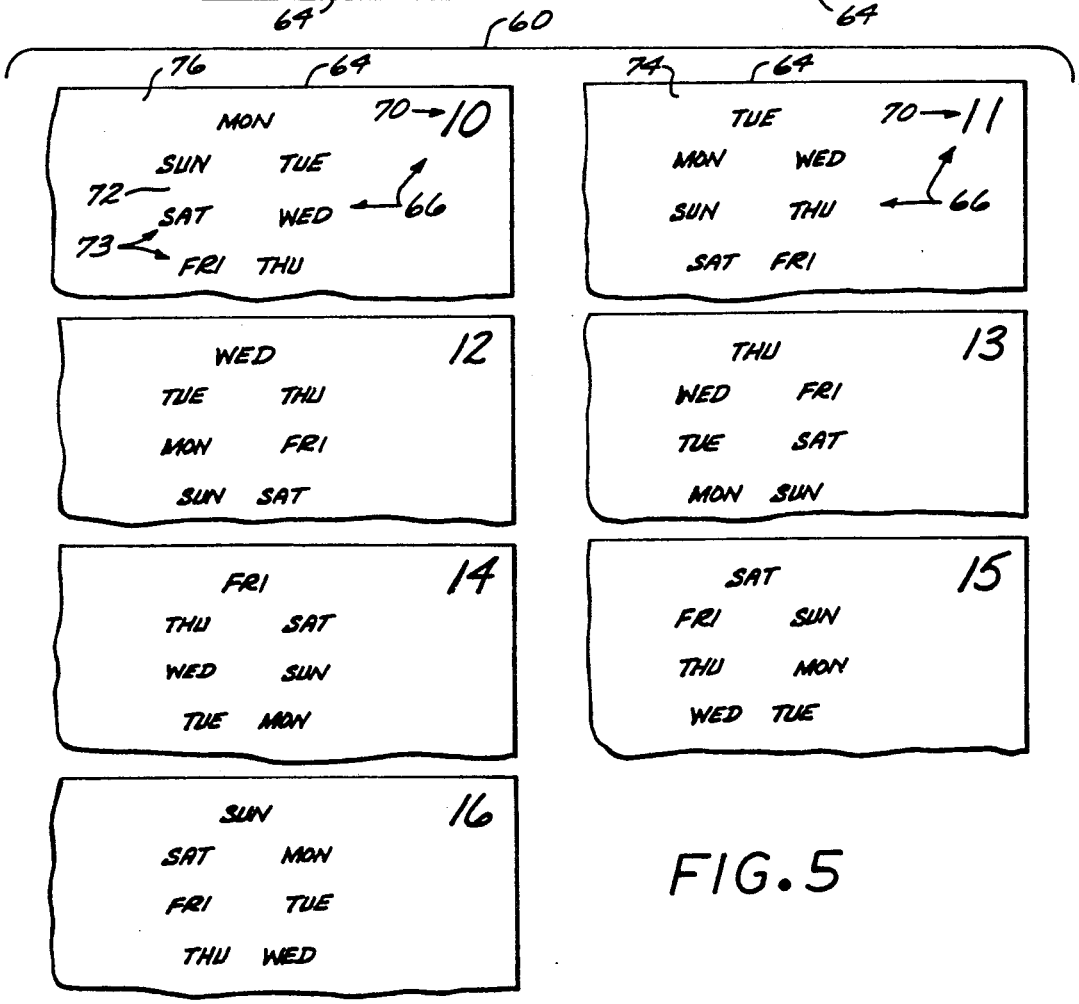
FIG. 5

CALENDRICAL DEVICE

BACKGROUND OF THE INVENTION

The present invention relates to calendrical devices, such as desk calendars and appointment books, and, more particularly, to a calendrical device that can selectively provide day and corresponding date information for successive years.

A number of calendrical devices are known which furnish a variety of calendaring information, such as days and their corresponding dates, selected daily hours or any combination of this information. Typical examples of devices of this nature include loose-leaf or pad-style desk calendars, appointment books, diaries and planners. Each of these devices normally contains a number of individual pages containing calendrical information. Calendrical devices of this type are also often incorporated into a variety of other publications, such as organizers, budget books and the like.

These known devices do, however, have disadvantages. For example, they are generally capable of preserving the correspondence between days and dates for only the particular calendar year designated on the individual pages of the calendrical device. This stems from the fact that the day corresponding to a given date is variable from year to year by an increment of one day for any two successive regular calendar years. Moreover, in the event that the first of any two successive years is a Leap Year, the increment for the second (i.e., non-Leap) year increases to two days for the period Jan. 1 to Feb. 28. On the other hand, if the second of any two successive years is a Leap Year, the increment for the second (i.e., Leap) year increases to two days for the period Mar. 1 to Dec. 31. Thus, for instance, an appointment book intended for use in the Leap Year 1988 and identifying each day and corresponding date on each separate page would not provide the proper correspondence between days and dates for the 1989 calendar year. Consequently, an individual that purchased the appointment book at some intermediate point in the year would be effectively deprived of the benefit of being able to use it for a full calendar year without personally editing the book in order to ensure proper day and date correspondence.

These disadvantages tend to be particularly costly to businesses that sell calendrical devices. For a retail business, the marketability of these devices tends to decrease with the progression of the calendar year. Thus, businesses often have a large inventory of calendrical devices which they must sell at a discount or seek to return to the manufacturer. Correspondingly, manufacturers are typically forced to accept returns of calendrical devices which have lost their marketability but are otherwise of good quality. They may also have to cut a new die for each calendar year in order to manufacture a calendrical device suitable for a succeeding year.

One approach toward addressing these disadvantages has been to add an extra calendar year of day and date pages to the calendrical device so as to make it useable for two years. This approach, however, does not compensate for the reduced utility of portions of the calendrical device having day and date information relating to days and dates that already occurred by the time an individual begins using the device. This approach also may prove undesirable in the case of publications, such as budget books, which may have other informational sections intended to be used only in a single calendar year.

Another approach has been to insert a series of master calendar years as part of the index section of the calendrical device. Thus, a calendrical device intended for use in the calendar year 1988 may have an index containing master calendar years 1989 through 1990. This, however, requires the individual to constantly refer to the master calendar in order to obtain the proper day corresponding to a date in 1989 or 1990.

It should, therefore, be appreciated that there has existed a definite need for a cost effective and simple calendrical device that can provide the proper day corresponding to a given date for successive years and, thereby, allow an individual to effectively use the device for a full year or more, irrespective of time of purchase of the device during that year.

SUMMARY OF THE INVENTION

The present invention, which addresses this need, provides a calendrical device that selectively furnishes day and corresponding date information for successive years. The device includes a plurality of successive pages which are interconnected together and which are associated with a day identification mechanism. Each page contains an event indicating legend which has a separate date indicator corresponding to a separate date and separate day indicia that are characterized by a plurality of day indicators. Each of the day indicators corresponds to an individual day of the week and is arranged in a predetermined incremental day order relative to its counterpart day indicator occupying substantially the same location on a preceding page. The day identification mechanism includes a day identifying member which has a day marker. The day marker is selectively alignable with any separate one of the day indicators when the day identifying member is placed on any one of the day indicia contained on a given page. Consequently, when the day marker is aligned in the aforementioned manner with a separate one of the day indicators, the calendrical device provides the appropriate day corresponding to the date contained on that page.

In more detailed aspects of the invention, the device includes a window that substantially corresponds in area to a single wedge increment. In this case, the day indicators contained within any separate one of the day indicia are spaced apart from one another substantially a single wedge increment. As such, when the day marker is properly aligned with a given day indicator, the proper day corresponding to a date appears within the window.

In still more detailed aspects of the invention, the device includes a suitable interconnection mechanism and the day identification mechanism is releasably attached to the interconnection mechanism so as to be optionally contiguous with any one of the pages. Further, the day identifying member includes a ruler which has a disk that is rotatably connected to the ruler and which houses the window. The ruler and window are further substantially transparent. When the disk is rotated a predetermined amount of wedge increments, the window aligns with the proper day indicator on a given page so as to provide the appropriate day corresponding to the date contained on that page. Moreover, the day identification mechanism also includes a base year indicator. The base year indicator corresponds to a calendar year, and is disposed on the day identifying member, and is selectively alignable with the window by appropriate rotation of the disk. The base year indicator also provides a reference year relative to which the disk can be rotated so as to determine the day and date for a given year.

More particularly, in order to appropriately align the disk when proceeding between any two successive regular calendar years, the disk will be rotated substantially a single wedge increment relative to the base year indicator. On the other hand, if the first of any two successive years is a Leap Year, the disk will be rotated substantially two wedge increments in a predetermined direction between the Leap Year and the beginning of the next successive calendar year. As of Mar. 1 of that calendar year, it will be rotated substantially one wedge increment in the opposite direction. Correspondingly, if the base year is a regular calendar year and the next successive year is a Leap Year, the disk will be rotated substantially a single wedge increment in a predetermined direction at the beginning of the Leap Year. As of Mar. 1 of that Leap Year, it will also be rotated substantially an additional single wedge increment in that direction. Consequently, the calendrical device provides corresponding day and date information for successive years.

In still other detailed aspects of the invention, the day indicia are arranged in a predetermined sequence which repeats itself every seven pages. Further, the day indicators within each day indicia together correspond to the seven days of the week. Therefore a single day difference exists between any two adjacent day indicators within each of the day indicia.

In one embodiment of the invention, each of the pages has a front side and a rear side and a separate event indicating legend is contained on each side of each of the pages. In this case, the aforementioned incremental day order is an increment of two successive days. That is, there is a difference of two days between any separate one of the day indicators and its counterpart day indicator that occupies substantially the same location on a next preceding page.

In another embodiment of the invention, each of the pages has a front side and a rear side and a separate one of the event indicating legends is contained on only one of the sides of each page. In this case, the incremental day order is in an increment of a single day. That is, there is a difference of a single day between any separate one of the day indicators and its counterpart day indicator which occupies substantially the same location on a next preceding page.

Other features and advantages of the present invention will become apparent from the following description of the preferred embodiments, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 4 is a plan view of a second embodiment of the invention associated with a loose-leaf desk calendar.

FIG. 5 is an illustrative depiction of a sequence of event indicating legends as they would appear on seven successive pages of the desk calendar of FIG. 5 in accordance with the second embodiment of the invention.

DESCRIPTION OF THE PREFERRED EMBODIMENTS

Figure 1:
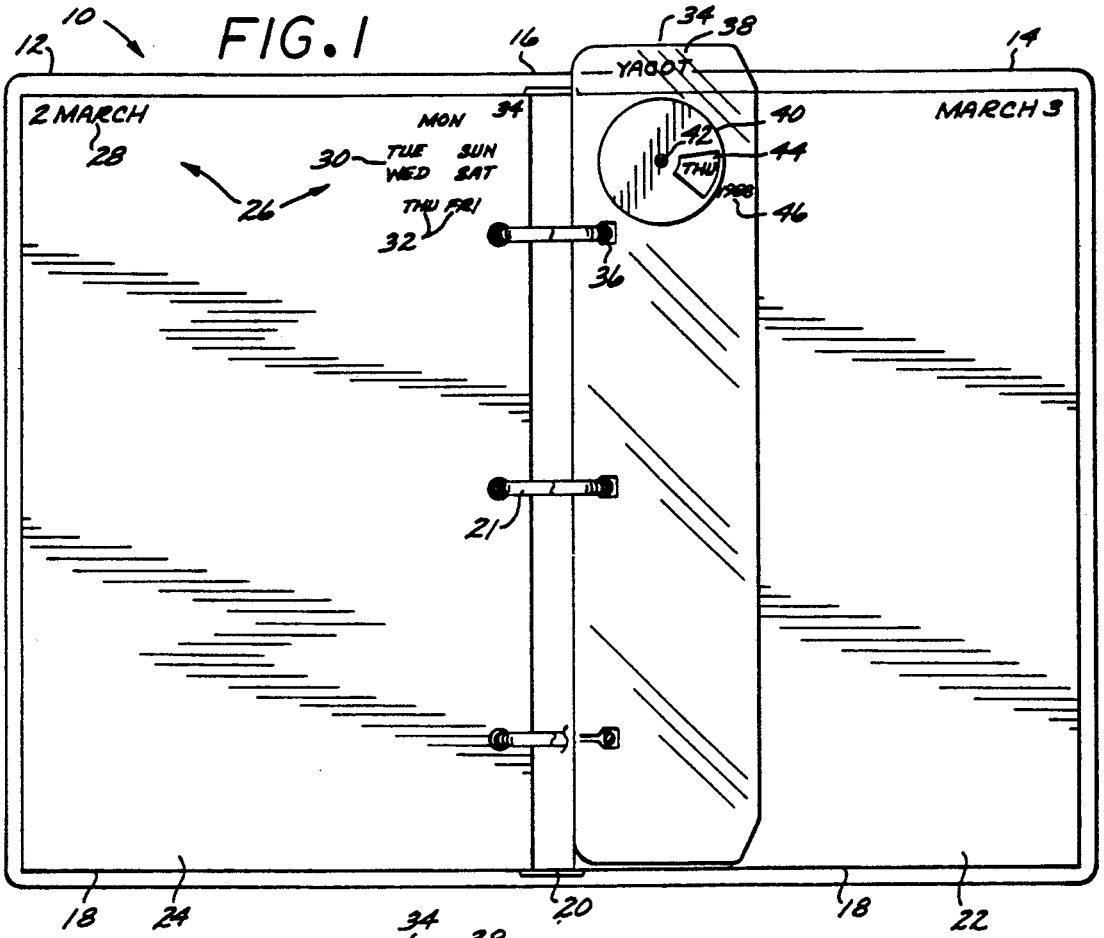
FIG. 1 is a plan view of a first embodiment of the invention showing the calendrical device associated with a loose-leaf binder.

With reference now to the drawings, and particularly to FIG. 1, there is shown a calendrical device that includes a binder 10, in a fully opened position, having a front panel 12 and a back panel 14 coupled by a spine 16. As is conventional, the binder 10 also has a number of loose-leaf pages 18 which are releasably interconnected to each other by a holder 20 which has three rings 21 and is attached to the inner surface of the spine 16. Each page 18 has a front side 22 and a rear side 24. Each side 22 and 24 has an event indicating legend 26 which includes a separate date indictor 28 and a set of separate day indicia 30 having a number of separate day indicators 32. Each legend 26 is located along the upper portion of its corresponding page with its particular date indicator 28 and set of day indicia 30 spaced apart from each other. (See FIG. 1)

As shown in FIG. 1, the rear side 24 of the page 18 located to the left of the holder 20 bears the date indicator 28 of Mar. 2. Each successive side of a page 18 also contains a different date indicator 28 in accordance with the normal daily progression of a calendar year. It will also be appreciated that each event indicating legend 26 can also convey other calendrical information, such as selected daily hours. In that event, a pre-selected number of daily hours are typically listed on each side of each page 18. One side (not shown) of one of the pages 18 also advantageously contains the Leap Year day Feb. 29, with a suitable listing of which years are Leap Years. Thus, the user is apprised as to the years on which this side of the page should be used.

In accordance with one embodiment of the present invention, shown in FIG. 1, the calendrical device further includes a day identification mechanism 34. The mechanism 34 has three apertures 36 along one edge adapted to receive the rings 21, such that the mechanism 34 is releasably attached to the holder 20 and can turn like a page 18 in the binder 10. In this way, the mechanism 34 can be placed over the separate day indicator 32 within any set of day indicia 30 contained on each side 22 and 24 of each page 18 so as to provide the appropriate day corresponding to a given date for more than one year. Moreover, each constituent day indicator 32 within each set of day indicia 30 is arranged in a specific order relative to its companion day indicators within the set and relative to its counterpart day indicator 28 occupying substantially the same location on a next preceding or next successive page. Thus, an individual can effectively use the device as a calendar for a full year or more irrespective of the time of the year at which the device was purchased.

The day identification mechanism 34 is rotatable substantially 180 degrees about the spine 16 by sliding the mechanism 34 along the rings 21 of the holder 20, just like the pages 18. The mechanism 34 includes a day identifying member 38 which has a disk 40 rotatably attached to a pin 42 that is secured to the upper portion of the day identifying member 38. (See FIGS. 1 and 3.) The day identifying member 38 has an elongated, flat surface. It can be a transparent plastic ruler which is suitably dimensioned so as to properly fit within the binder 10. The disk 40 is centrally disposed about the pin 42 and is substantially flush with, and adjacent to, the surface of the day identifying member 38. It further defines a substantially transparent and wedge shaped day marker or window 44 that occupies a section of the disk 40. The top of the window 44, where the cross-section of the window is smallest, terminates near the center of the disk, while its curved base terminates near the periphery of the disk 40.

A separate base year indicator 46 can also be suitably positioned as imprinted on the day identifying member 38 at a predetermined location along the periphery of the disk 40. This provides a convenient reference year relative to which the user can appropriately, incrementally rotate the disk 40 so as to determine the day and date for a given year. Thus, in the event that the year was 1988 (a Leap Year), the user can preset the identification mechanism 34 to provide appropriate days and dates for 1988 by rotating the disk 40 and aligning the window 44 with the 1988 year indicator. (See FIG. 1) For 1989, the user would then know to rotate the disk 40 about two wedge increments relative to the 1988 year indicator in order to obtain the appropriate day corresponding to a given date during the period from Jan. 1 to Feb. 28, 1989. Correspondingly, the user would rotate the disk 40 about a single wedge increment relative to the 1988 year indicator in order to obtain the appropriate day corresponding to a given date during the period Mar. 1 to Dec. 31, 1989. Rotation of the disk 40 in the manner generally described above and use of the day identification mechanism 34 for successive years will be described in more detail below.

It will be understood that a wedge increment is substantially equal to the total surface area defined within the window 44. Moreover, it will further be understood that the window 44 need not specifically be a wedge shaped window within which a given day appears. Thus, any of a number of other types of day markers, such as an arrow imprinted on the day identifying member 38, can be utilized to mark the appropriate day indicator 32 within each set of day indicia 30.

Figure 2:
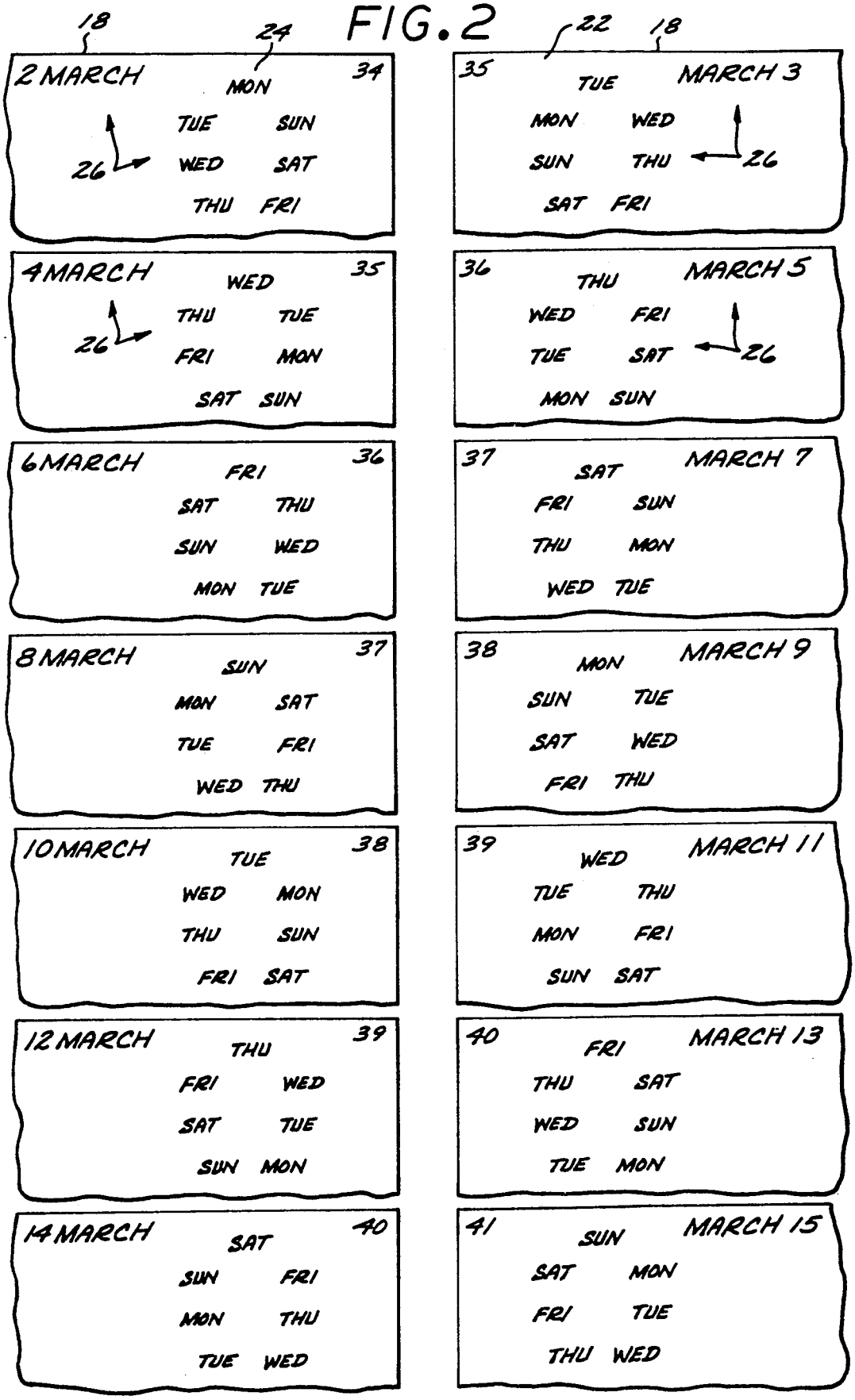
FIG. 2 is an illustrative depiction of a sequence of event indicating legends as they would appear on seven successive pages of the binder of the first embodiment of the invention.

Each separate set of day indicia 30 is contained on each side 22 and 24 of each page 18 at a predetermined location such that the window 44 can selectively align with each constituent day indicator 32 within the particular set. To that end, as shown in FIG. 1, each set of day indicia 30 occupies the upper portion of each side 22 and 24 of each page 18 adjacent to the holder 20. The day indicators 32 within each set of day indicia 30 are also advantageously arranged in a predetermined sequence that allows the window 44 to align with the appropriate day corresponding to a given date. More particularly, as depicted in FIG. 2, each set of day indicia 30 has seven separate day indicators 32. Each day indicator 32 corresponds to one of the seven days of the week and appears in abbreviated form. For example, "SAT" refers to Saturday. Each day indicator 32 is further sufficiently separated from its constituent day indicator 32, preferably by about a single wedge increment, so that more than one day indicator 32 does not selectively align with the window 44 at the same time.

Each day indicator 32 within each set of day indicia 30 is also arranged so that there is a predetermined increment of two days between it and a similarly situated day indicator 32 within another set of day indicia 30 located a full page behind it. Consequently, as depicted in FIG. 2, each day indicator 32 situated on the front side 22 of the page 18 numbered 37 represents an increment of two days over each similarly situated day indicator 32 contained on the front side 22 of page 18 numbered 36. It will be observed that in FIG. 2 the Mar. 7 date indicator appears on the front side of page 18 numbered 37 and the Mar. 5 date indicator appears on the front side of page 18 numbered 36. Correspondingly, each day indicator 32 situated on the rear side 24 of the page 18 numbered 37 represents an increment of two days over each similarly situated day indicator 32 on the rear side 24 of the page 18 numbered 36. It will be observed that in FIG. 2 the Mar. 8 date indicator appears on the rear side of page 37 and the Mar. 6 day indicator appears on the rear side of the page 18 numbered 36.

It will be appreciated that the aforementioned predetermined incremental day order stems from the fact that the calendrical device shown in FIG. 1 has two days per page spread (i.e., one day on each side of each page). A "page spread" refers to the rear side 24 of one page 18 and the front side 22 of a next succeeding page 18 when the binder 10 is in a fully opened position. (See FIG. 1). Further, a complete cycle of sets of day indicia 30 occurs every seven pages and repeats itself in seven page increments. (See FIG. 2).

Figure 3:
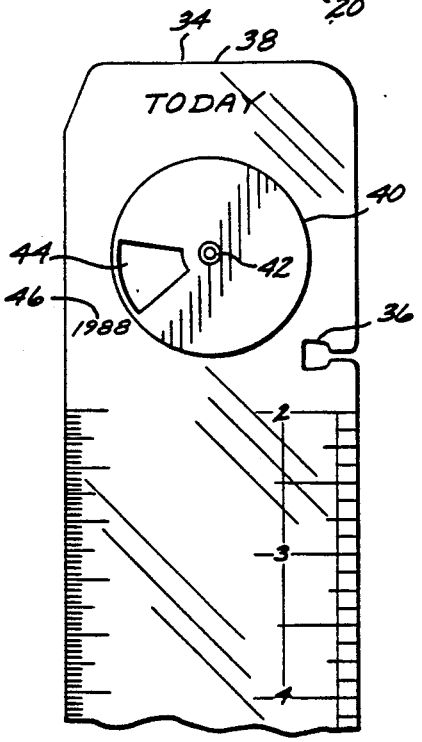
FIG. 3 is a somewhat enlarged fragmentary top view of a day identification mechanism of the first embodiment of the present invention showing a day identifying window.

The operation of the first embodiment of the present invention will now be discussed with particular reference to FIGS. 1–3. As shown in FIG. 1, the day identification mechanism 34 is initially attached to the rings 21 of the holder 20 such that it is substantially flush with the front side 22 of the page 18 numbered 35 having the date indicator, Mar. 3. Therefore, the disk 40 covers the corresponding day indicia 30 on the front side 22 of the page 18 numbered 35. Thereafter, if appropriate, the disk 40 is rotated about the pin 42 a suitable amount of wedge increments until the window 44 aligns with the base year indicator 46. As shown in FIG. 1, the base year indicator 46 here corresponds to the reference calendar year of 1988. The window 44 is now in a position to automatically align with the proper day indicator 32 corresponding to a given date in 1988 appearing on page 35 as well as any preceding or successive page. In the case of the page having the Mar. 3 date indicator 28, the corresponding day indicator, Thursday (abbreviated "THU"), appears in the window 44. Moreover, alignment of the window 44 with the reference year of 1988 furnishes a reference position from which the user can determine the amount of wedge increments to rotate the disk 40 during a succeeding or preceding year so as to provide proper day and date information during such a year.

If it is desired to determine the particular day corresponding to date indicator of Mar. 2 in 1988, the user simply rotates the day identification mechanism 34 substantially 180 degrees by sliding it along the rings of the holder 20. The mechanism 34 then moves off of the page 18 numbered 35 and assumes a position substantially flush with the rear side 24 of the page 18 that is numbered 34 and has the Mar. 2 date indicator 28. (See FIGS. 1–2). Consequently, the day indicator Wednesday (abbreviated "WED"), appears in the window 44, thereby indicating that Mar. 2 is a Wednesday in 1988. It will be observed that in lieu of rotating the mechanism 34 the user could simply have temporarily detached the mechanism 34 from the rings 21 of the holder 20 and then attached it again after suitably manipulating the mechanism 34. In either case, the disk 40 will cover the day indicia 30 on the page 18 numbered 34 and the window 44 will align with the proper day indicator 32.

Suppose now that it is desired to determine the proper day corresponding to Mar. 6, 1988. To do so, the day identification mechanism 34 is detached from the rings 21 of the holder 20. The page 18, numbered 36 in FIG. 2 and bearing the day indicator of Mar. 5 on its front side 12, is turned over by sliding it along the rings 21. (See FIG. 2). As a result, the rear side 24 of the page 18, numbered 36 and situated to the left of the holder 20, now contains the date indicator 28 of Mar. 6. Correspondingly, the front side 22 of the next page 18, numbered 37 in FIG. 2 and located to the right of the holder 20, contains the date indicator 28 of Mar. 7. (See FIG. 2).

Then, the identification mechanism 34 is attached again to the rings 21 and positioned substantially flush with the rear side 24 of the page 18 numbered 36 in FIG. 2 and having the date indicator, Mar. 6. The day Sunday (abbreviated "SUN") now appears in the window 44, thereby conveying to the user that Mar. 6, 1988 is a Sunday. It will be observed that there is an increment of two days between this day indicator 32 and another similarly situated day indicator 32 located on the next preceding page. That is, the day indicator 32 for Mar. 6, 1988 is Sunday ("SUN"), while the day indicator 32 for Mar. 4, 1988 is Friday ("FRI"). (See FIG. 2).

Similarly, to determine the day corresponding to Mar. 7, 1988 the identification mechanism 34 is rotated substantially 180 degrees by sliding it along the rings 21 of the holder 20. The disk 40 thus overlaps the particular set of day indicia 30 situated on the front side 22 of the page 18, numbered 37 in FIG. 2 and having the Mar. 7 date indicator 28. (See FIG. 2). The day Monday (abbreviated "MON") then appears in the window 44. It will again be observed that the aforementioned two day increment applies and that subsequent days and corresponding dates are determined in the same manner.

For the purpose of determine a day corresponding to a date in a succeeding year, the disk 40 is first selectively rotated a predetermined amount of wedge increments about the pin 42. The degree of rotation will depend on whether either the reference year or next succeeding year is a regular calendar year or a Leap calendar year. If the reference year with which the window 44 is initially aligned is a Leap Year (such as 1988), then the disk 40 is rotated substantially two wedge increments for the days of Jan. 1 to Feb. 28 of the next succeeding year. This incremental rotation will then ensure that the calendrical device will furnish the proper correspondence between days and dates during the period Jan. 1 to Feb. 28 inclusive. However, for the days Mar. 1 to Dec. 31, the rotation is substantially only a single wedge increment, relative to the reference year. Alternatively, as of Mar. 1 the user could also simply rotate the disk 40 about a single wedge increment in the opposite direction.

On the other hand, if the reference year is a regular calendar year and the next succeeding year is a Leap Year, the disk 40 is rotated substantially a single wedge increment for the days Jan. 1 to Feb. 29, and substantially two wedge increments for the days Mar. 1 to Dec. 31. Finally, if neither the reference year nor the next succeeding year is a Leap Year, the rotation relative to the reference year is simply about a single wedge increment.

The direction of rotation of the disk 40 relative to the reference year will depend upon whether the identification mechanism 34 is flush with a side of a page located on the left or the right side of the holder 20. In the event that the identification mechanism 34 is "left side" flush, the direction of rotation is counter-clockwise. On the other hand, if the mechanism 34 is "right-side" flush, the direction of rotation is clockwise.

An alternative embodiment of the calendrical device of the present invention is depicted in FIG. 4. In this embodiment, the calendrical device includes a conventional desk calendar frame 60 having two separate rings 62 which are attached to the center of the frame 60 and releasably receive a number of loose-leaf pages 64. (See FIG. 5). The pages 64 are slidably along the rings 62 in the same manner as the pages 18 associated wit the binder 10 of the previous embodiment. The device further includes event indicating legends 66 (see FIGS. 4–5) and a day identification mechanism 68 which is similar to the mechanism 34 of the previous embodiment and is similarly releasably attached to the rings 62. The mechanism 68 thus has a day identifying member 69 which is similar to the member 38 of the previous embodiment.

Like the legends 26 of the previous embodiment, each event indicating legend 66 has a separate date indicator 70 and a separate set of day indicia 72 having a plurality of day indicators 73. Unlike the legends 26 of the previous embodiment, however, the legends 66 of this embodiment are arranged to accommodate a calendrical device having one date per page spread. More specifically, as depicted in FIG. 4, the rear side 76 of any given page 64 and the next succeeding front side 74 of a page 64 both bear the same date indicator 70. Moreover, each set of day indicia 72 are located on the upper portion of the front side 74 of a given page 64. Each set of indicia 72, therefore, occupies a predetermined location to the right of the rings 62 such that the day marker or window 77 can selectively align with each constituent day indicator 73 within a particular set of day indicia 72. A separate base year indicator 80 can also be positioned on the day identifying member 69. (See FIG. 4).

As with the calendrical device of FIG. 1, each day indicator 73 within a given set or day indicia 72 corresponds to one of the seven days of the week and appears in abbreviated day form. Additionally, they are suitably separated from each other so that more than one day indicator 73 within a particular set of day indicia 72 does not selectively align with the window 77 at the same time. However, each day indicator 73 within each set of day indicia 72 is arranged so that there is a predetermined increment of substantially one day between it and a similarly situated day indicator 73 located a full page behind. For example, as shown in FIG. 5, each day indicator 73 situated on the front side of the page having the Jan. 11 day indicator is an increment of one day ahead of each similarly situated day indicator contained on the front side of the page having the Jan. 10 day indicator. Further, while a complete cycle of sets of day indicia 72 concludes on every seventh page and then begins anew, it will be observed that the sequence of sets of day indicia 72 differs from that of the embodiment of FIG. 1 (Compare FIGS. 2 and 5). It will also be understood that other kinds of day markers or windows 44 can be employed.

The operation of the alternative embodiment of the calendrical device of FIG. 5 is substantially the same as that of the embodiment of FIG. 1. However, since each set of day indicia 72 is contained on the front side 74 of every page 64, the day identification mechanism 68 need only assume a "right side" flush position for the window 44 to indicate the day corresponding to a given date. Moreover, days and corresponding dates for succeeding years relative to the reference year are determined by rotating the disk 78 on the day identifying member 69 clockwise a suitable number of wedge increments.

Although the invention has been described in detail with reference to the presently preferred embodiments, it will be appreciated by those skilled in the art that various modifications can be made without departing from the spirit and scope of the invention. Accordingly, the invention is not to be limited by the particular embodiments above but is to be defined only by the claims set forth below and equivalents thereof.

I claim:

1. A calendrical device, comprising:

a plurality of successive interconnected pages;

a plurality of event indicating legends, each of said legends being contained on a separate one of said pages and each of said legends having a separate date indicator corresponding to a separate date and having separate day indicia characterized by a plurality of day indicators, each of said day indicators corresponding to an individual day of the week and being arranged in a predetermined incremental day order relative to their counterpart day indicators occupying substantially the same location on a preceding page; and day identification means for identifying the day of the week corresponding to a particular date, said identification means including a day identifying member which is interactive with said pages and has a day marker that is adapted to be selectively alignable with a separate one of said day indicators so as to provide the appropriate day corresponding to said separate date on each of said pages.

2. A calendrical device as recited in claim 1, wherein:

each of said pages has a front side and a rear side; and a separate one of said legends is contained on each of said sides of each of said pages.

3. A calendrical device as recited in claim 2, wherein said incremental day order is in an increment of two successive days with a two day difference between any separate one of said day indicators and its counterpart day indicator occupying substantially the same location on a next preceding page.

4. A calendrical device as recited in claim 1, wherein:

each of said pages has a front side and a rear side; and a separate one of said legends is contained on one of said sides of each of said pages.

5. A calendrical device as recited in claim 4, wherein said incremental day order is in an increment of a single day with a single day difference between any separate one of said day indicators and its counterpart day indicator occupying substantially the same location on a next preceding page.

6. A calendrical device as recited in claim 1, wherein said day indicia are arranged in a predetermined sequence which repeats itself every seven of said pages.

7. A calendrical device as recited in claim 1, wherein said day indicators of each of said day indicia together correspond to the seven days of a week.

8. A calendrical device as recited in claim 1, wherein:

a single day difference exists between any two adjacent day indicators situated within any separate one of said day indicia; and said day indicators within any separate one of said day indicia each correspond to a separate one of the seven days of a week and are each spaced apart substantially a single wedge increment from each other.

9. A calendrical device as recited in claim 1, further comprising means for interconnecting said pages, and wherein said day identification means is releasably attached to said means for interconnecting so as to be optionally contiguous with any one of said pages.

10. A calendrical device as recited in claim 1, wherein:

said day marker includes a window that substantially corresponds in area to a single wedge increment; and said day indicators within any separate one of said day indicia are each spaced apart substantially a single wedge increment from each other.

11. A calendrical device as recited in claim 10, wherein said day identifying member further includes:

a ruler; and a disk housing said window and being rotatably connected to said ruler;

whereby, upon selective rotation of said disk a predetermined amount of wedge increments, said window aligns with a separate one of said day indicators so as to provide the appropriate day corresponding to said separate date.

12. A calendrical device as recited in claim 10, wherein said ruler and said window are substantially transparent.

13. A calendrical device as recited in claim 11, wherein said day identification means further includes a base year indicator which corresponds to a calendar year and is disposed on said day identifying member and is selectively alignable with said window.

14. A calendrical device, comprising:

a plurality of successive interconnected pages;

a plurality of event indicating legends, each of said legends being contained on a separate one of said pages and each of said legends having a separate date indicator corresponding to a separate date and having separate day indicia characterized by a plurality of day indicators, each of said day indicators corresponding to an individual day of the week and being arranged in a predetermined incremental day order relative to their counterpart day indicators occupying substantially the same location on a preceding page; and day identification means for identifying the day of the week corresponding to a particular date, said identification means including a day identifying member which is releasably attached to said means for interconnecting so as to be optionally contiguous with any one of said pages and defines a window that is selectively alignable with a separate one of said day indicators so as to provide the appropriate day corresponding to said separate date on each of said pages.

15. A calendrical device as recited in claim 13, wherein:

each of said pages has a front side and a rear side; and a separate one of said legends is contained on each of said sides of each of said pages.

16. A calendrical device as recited in claim 14, wherein said incremental day order is in an increment of two successive days with a two day difference between any separate one of said day indicators and its counterpart day indicator occupying substantially the same location on a next preceding page.

17. A calendrical device as recited in claim 13, wherein:

each of said pages has a front side and a rear side; and a separate one of said legends is contained on one of said sides of each of said pages.

18. A calendrical device as recited in claim 16, wherein said incremental day order is in an increment of a single day with a single day difference between any separate one of said day indicators and its counterpart day indicator occupying substantially the same location on a next preceding page.

19. A calendrical device as recited in claim 13, wherein:

a single day difference exists between any two adjacent day indicators situated within any separate one of said day indicia; and said day indicators within any separate one of said day indicia each correspond to a separate one of the seven days of a week and are each spaced apart substantially a single wedge increment from each other.

* * * * *

UNITED STATES PATENT AND TRADEMARK OFFICE

CERTIFICATE OF CORRECTION

PATENT NO. : 5,125,688

DATED : JUNE 30, 1992

INVENTOR(S) : RONALD M. BIANCO

It is certified that error appears in the above-identified patent and that said Letters Patent is hereby corrected as shown below:

On the Title page, item [57], last line of Abstract, "corresponds" should be --corresponding--.

col. 7, line 11, "side 12" should be -- side 22 --.

Signed and Sealed this

Tenth Day of August, 1993

*Attest:*

Michael K. Kirk

MICHAEL K. KIRK

*Attesting Officer*

*Acting Commissioner of Patents and Trademarks*